US009144311B2

(12) United States Patent
Romero

(10) Patent No.: US 9,144,311 B2
(45) Date of Patent: Sep. 29, 2015

(54) INTEGRATED CHAIR BACK AND SEAT MOVEMENT

(71) Applicant: Office Master, Ontario, CA (US)

(72) Inventor: Francisco Romero, Los Angeles, CA (US)

(73) Assignee: Office Master, Ontario, CA (US)

( * ) Notice: Subject to any disclaimer, the term of this patent is extended or adjusted under 35 U.S.C. 154(b) by 216 days.

(21) Appl. No.: 13/911,442

(22) Filed: Jun. 6, 2013

(65) Prior Publication Data

US 2014/0361588 A1 Dec. 11, 2014

(51) Int. Cl.

| | |
|---|---|
| ***A47C 1/024*** | (2006.01) |
| ***A47C 1/00*** | (2006.01) |
| ***A47C 15/00*** | (2006.01) |
| ***A47C 1/032*** | (2006.01) |
| ***A47C 1/124*** | (2006.01) |

(52) U.S. Cl.

CPC ..... *A47C 1/03294* (2013.01); *A47C 1/03255* (2013.01); *A47C 1/124* (2013.01)

(58) Field of Classification Search

CPC . A47C 1/124; A47C 1/03294; A47C 1/03255
USPC ..... 297/248, 300.1, 300.5, 302.1, 302.4, 297/446.2, 342, 300.2, 411.29, 359, 445.1, 297/452.15, 411.25

See application file for complete search history.

(56) References Cited

U.S. PATENT DOCUMENTS

| | | | | |
|---|---|---|---|---|
| 2,627,898 | A * | 2/1953 | McStay Jackson | 297/342 |
| 3,271,070 | A * | 9/1966 | Dlouhy et al. | 297/188.18 |
| 3,567,280 | A * | 3/1971 | Bradshaw | 297/318 |
| 4,549,711 | A * | 10/1985 | Giltnane | 248/188 |
| 4,978,168 | A * | 12/1990 | Piretti | 297/248 |
| 5,076,646 | A * | 12/1991 | Matte | 297/452.14 |
| D462,535 | S | 9/2002 | Lucci et al. | |
| D477,925 | S | 8/2003 | Lucci et al. | |
| D487,642 | S | 3/2004 | Lucci et al. | |
| 6,722,735 | B2 | 4/2004 | Lucci et al. | |
| D492,496 | S | 7/2004 | Lucci et al. | |
| D495,905 | S | 9/2004 | Lucci et al. | |
| D497,065 | S | 10/2004 | Lucci et al. | |
| D498,095 | S | 11/2004 | Lucci et al. | |
| 6,935,690 | B2 | 8/2005 | Lucci et al. | |

* cited by examiner

*Primary Examiner* — Milton Nelson, Jr.
(74) *Attorney, Agent, or Firm* — Andrus Intellectual Property Law, LLP

(57) ABSTRACT

A chair having an integrally molded chair back and seat that move together upon reclining movement of a user. The seat includes a series of glides that travel along a glide track mounted to a fixed support frame. A bias spring, connects the support frame to the seat and chair back to urge the seat and chair back into an upright position. The chair includes a pair of ganging arms that are movable between a storage position and an operative position. In the storage position, the ganging arms are concealed within a bottom cover. When in the extended, operative position, the ganging arms allow multiple chairs to be ganged together.

16 Claims, 7 Drawing Sheets

27
28
26
30
32
24b
10
30
32
12
11
4
4
58
58
38
24b
11
52
24a
24b 66
72
80
76
82
80
82
58

66
5
5
70
72
68
84
58
64
62
67

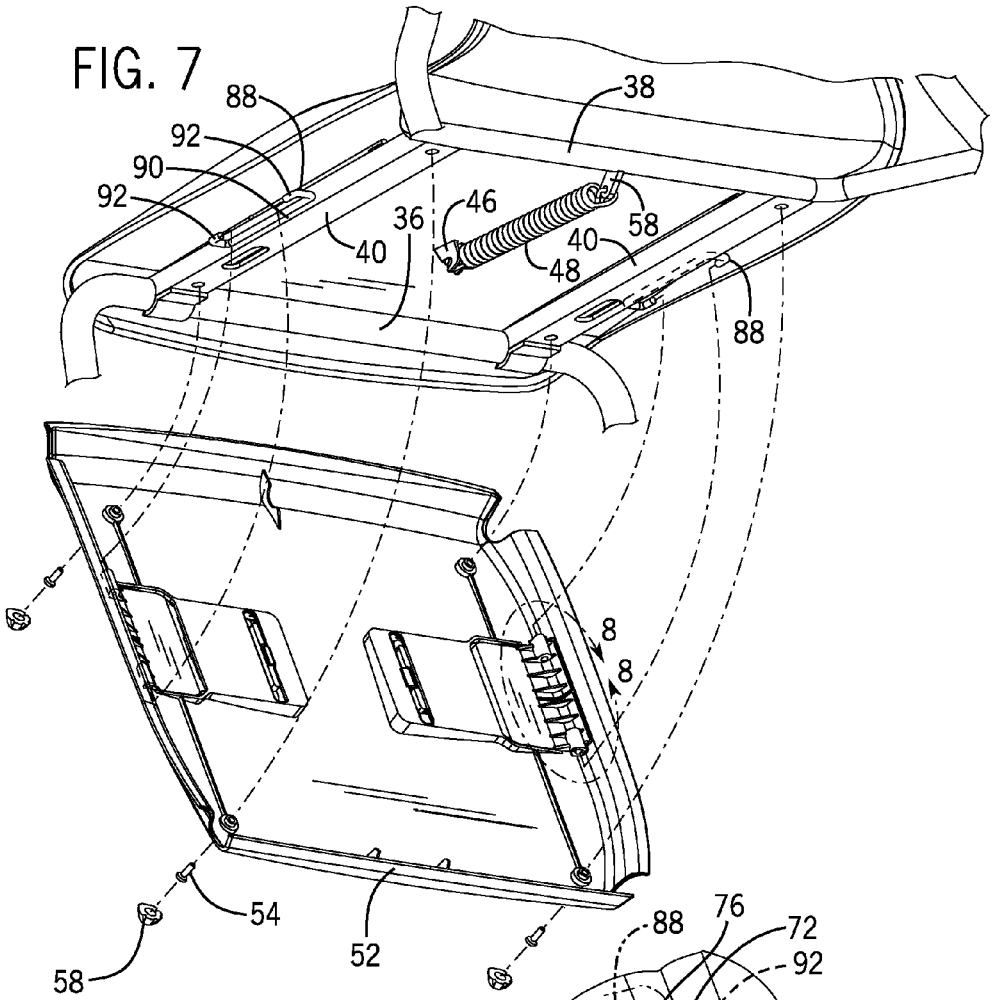
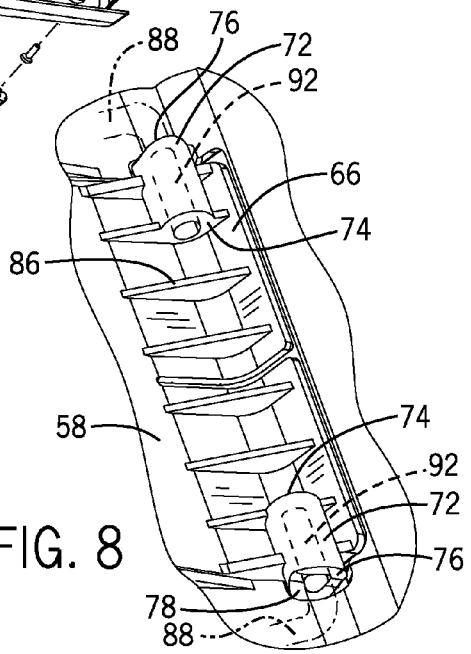
FIG. 8

INTEGRATED CHAIR BACK AND SEAT MOVEMENT

BACKGROUND

The present disclosure relates to a chair having an integrated seat and chair back. More specifically, the present disclosure relates to a chair in which the chair back and seat move together to provide a reclining position for the user and which further includes integral ganging arms movable between storage and operative positions.

Presently, many different types of high density, low cost stackable chairs are available for use as both economical and temporary seating. The use of these low cost stacking chairs has resulted in a very large number of different types of chairs that have a stationary seat and a stationary chair back.

Recently, the focus in the seating industry has been to create ergonomic designs that increase the comfort level for the seat occupant. One large aspect of increasing user comfort is to provide a chair that can move between an upright and a reclined position. Many of the most commonly available stacking chairs do not provide any ability for the chair back to recline relative to the seat. Designs that do allow the chair back to recline relative to the seat do not include any ability for the seat to move forward at the same time as the reclining movement of the chair back.

U.S. Pat. Nos. 6,722,735 and 6,935,690 disclose embodiments of chairs in which the chair back and seat are movable to increase comfort for the seat occupant. Although these two references disclose a chair having integrated movement between the chair back and seat, the mechanisms used to affect such movement suffer from deficiencies in both manufacturing and function.

Since low cost stacking chairs are often used in creating rows of seating, there is a desire to include some type of ganging mechanism that allows the chairs to be joined together to define the desired rows. Various types of ganging devices have been developed to link chairs together in such a manner. However, many of these ganging devices include some type of bracket that extends from the side of the chair, which can create problems when the chairs are not used in a ganged application.

SUMMARY

The present disclosure relates to a chair that includes a chair back and seat that move together to provide a reclining position for the user and which includes integral ganging arms. The ganging arms can each be moved between an operative position to join adjacent chairs and a storage position in which the ganging arms are Concealed beneath the seat.

The chair includes a support frame having a pair of front legs and a pair of rear legs. The support frame further includes a pair of parallel spaced support brackets.

The chair includes a chair back that is pivotally connected between the pair of rear legs to provide the movement between the upright and reclining position. A seat is supported by the frame and is movable along the pair of support brackets that form a portion of the support frame. In one embodiment of the disclosure, the seat is integrally formed with the chair back as an Integral plastic shell. The seat is movable along a pair of inclined glide tracks that are each mounted to the support brackets. The seat includes at least two glides that are mounted to a bottom surface of the seat and are movable along the longitudinal length of the glides. In one embodiment of the disclosure, the glide tracks include a chrome upper surface that interacts with the glides to provide a desired amount of friction and feedback to a seat occupant during movement from the upright position to the reclined position.

A bias spring is positioned between the support frame and the seat to urge the seat and the chair back into the upright position. The weight of the seat occupant works with the inclined glide tracks and the bias spring to hold the chair back and seat in the upright position and exerts a bias force against the reclining movement of a seat occupant.

The chair further includes a pair of ganging arms that are movable relative to the seat member between a storage position and an operative position. When each of the ganging arms are in the operative position, the ganging anus extend past the side edges of the seat. When the ganging arms are in the operative position, the ganging arms of adjacent seats can be joined together to restrict the separation between the chairs.

Each of the ganging arms is pivotally supported on a mounting bracket that is attached to the support frame of the chair. Each ganging arm includes a pair of camming ends that engage the mounting brackets. The camming ends each include a cam surface that urges the ganging arms into either an operative position or a storage position. The operative and storage positions are defined by two portions of the cam surface that are located 180° apart from each other.

When the ganging arms are in the storage position, the ganging arms are received within cavities formed in a bottom surface of a stationary bottom cover mounted to the support frame. The bottom cover is positioned directly below the seat and is stationary when the seat moves along the support frame between the upright and reclined positions. When the ganging arms are in the storage position, the ganging arms are each received within the cavities formed in the bottom cover.

Each of the ganging arms includes a flexing zone positioned between the spaced camming ends. When the ganging arms move between the storage and operative positions, the camming ends cause the sides of each of the ganging arms to flex inward, which flexure is permitted by the flexing zone. When the ganging arms reach either the storage or operative positions, the ganging arms flex outward to hold the ganging arms in the desired position.

Various other features, objects and advantages of the invention will be made apparent from the following description taken together with the drawings.

BRIEF DESCRIPTION OF THE DRAWINGS

The drawings illustrate the best mode presently contemplated of carrying out e disclosure. In the drawings:

FIG. 7 is a partially exploded view illustrating the removal of the bottom cover;

FIG. 8 is a magnified view of the area shown by line 8-8 in FIG. 7;

DETAILED DESCRIPTION

Figure 1:
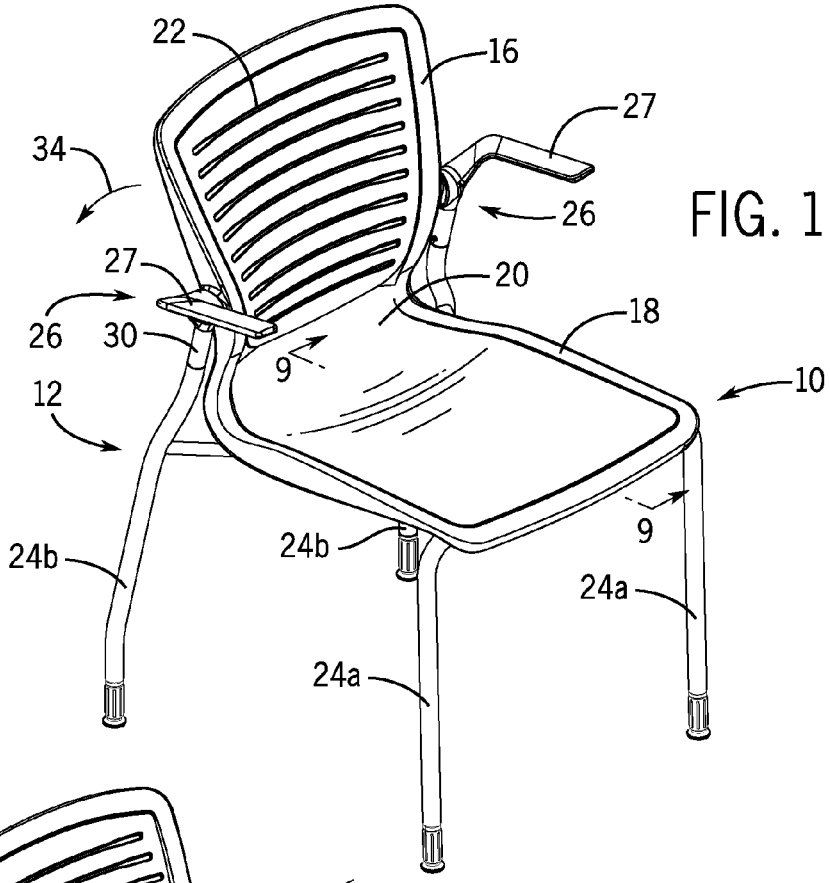
FIG. 1 is a front perspective view of a chair constructed in accordance with the present disclosure.
Figure 6:
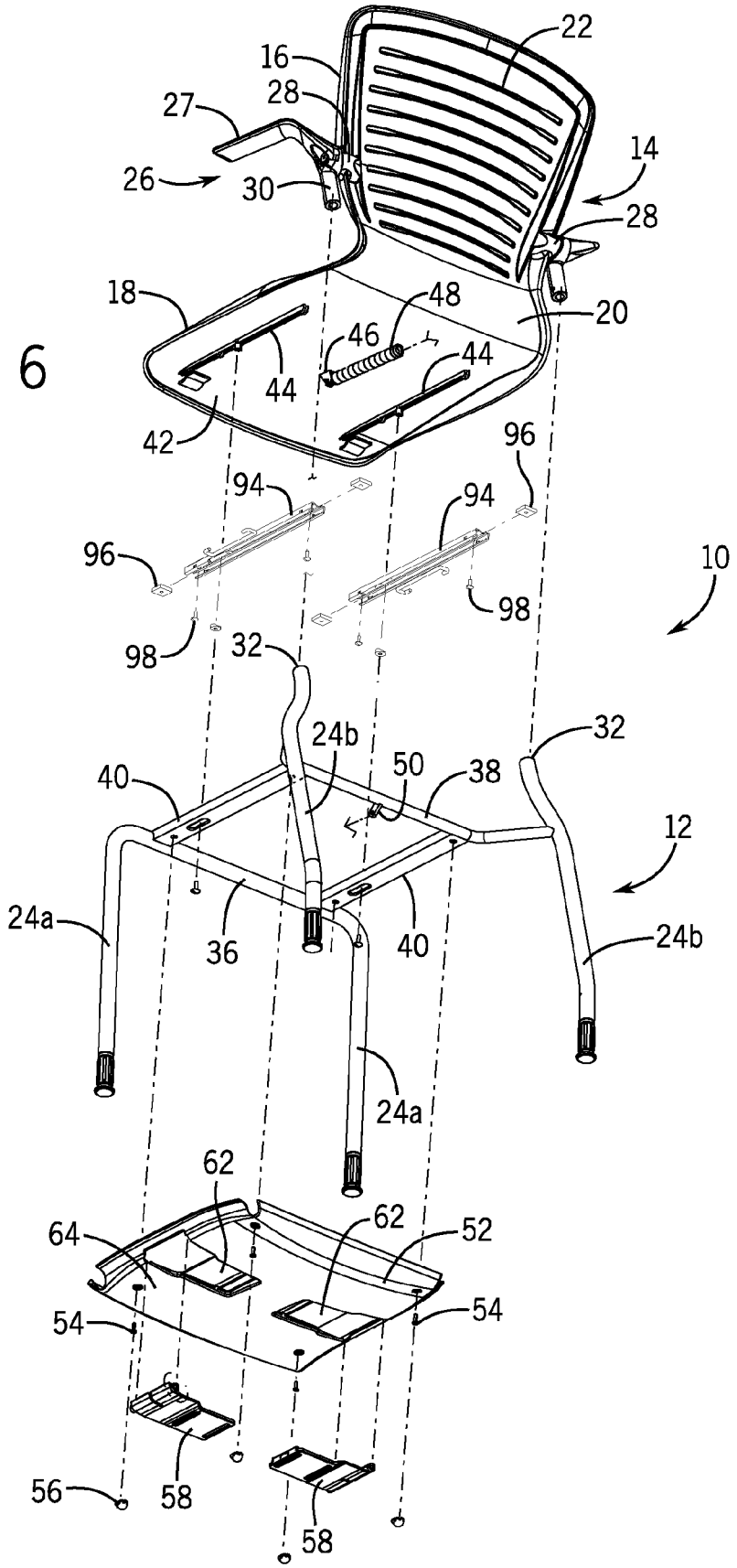
FIG. 6 is an exploded view of the chair shown in FIG. 1.

FIGS. 1 and 6 illustrate a chair 10 constructed in accordance with the present disclosure. The chair 10 includes a support frame 12 that supports an integrally molded shell 14. The shell 14 is molded from a plastic material and includes a chair back 16 and a seat 18. As illustrated in FIGS. 1 and 6, the chair back 16 and seat 18 are integrally molded components that are joined to each other by a flexible transition area 20. The flexible transition area 20 allows. relative movement between the chair back 16 and the seat 18. Specifically, the chair back 16 can recline relative to the seat 18 under the weight of a seat occupant. In the embodiment shown in FIGS. 1 and 6, the chair back 16 includes a series of spaced slats 22 that allows the chair back 16 to flex under the weight of an occupant.

Figure 3:
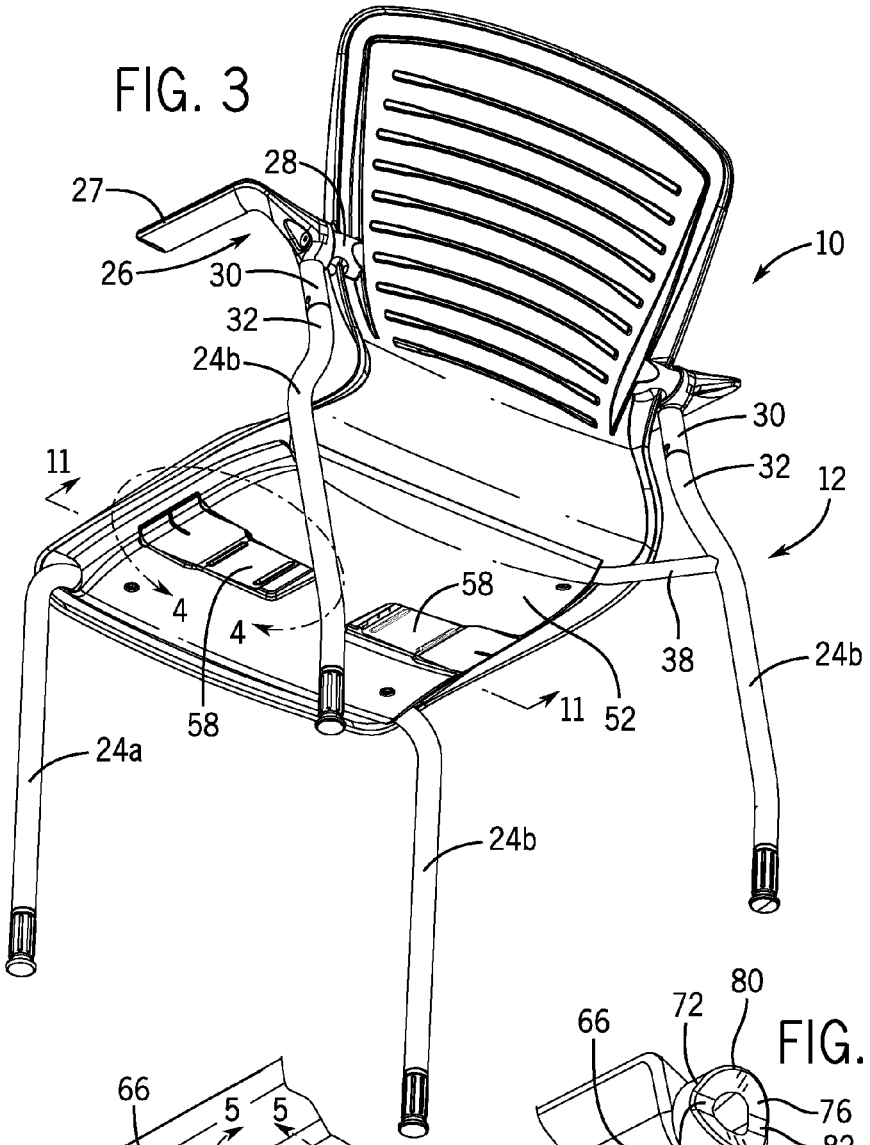
FIG. 3 is a bottom perspective view of the chair showing the ganging arms in the storage position.

As best illustrated in FIG. 6, the support frame 12 includes four legs that define a pair of front legs 24*a* and a pair of rear legs 24*b*. As illustrated in FIG. 1, the pair of rear legs 24*b* extend upwards past the seat 18 and support a pair of removable arm assemblies 26. As best shown in FIG. 3, the pair of arm assemblies 26 are each attached to the chair back 16 at a pivot bracket 28. Each arm assembly includes a down tube 30 that is received on an upper end 32 of one of the rear legs 24*b*. The down tube 30 securely attaches the aim assembly 26 to the rear leg 24*b*. The arm assembly 26 provides a pivoting point of connection with the pivot bracket 28 which allows the chair back 16 to recline in the direction shown by arrow 34 in FIG. 1.

Although the embodiment shown in FIGS. 1 and 6 includes a generally horizontal arm 27, the entire arm assembly 26 can be removed in an alternate embodiment and preplaced with an arm assembly that eliminates the arm 27 and only includes the down tube 30 and the connection to the pivot bracket 28. In this manner, the chair 10 can be easily converted into an embodiment that does not include any arms.

Figures 11, 12, 13, 14:
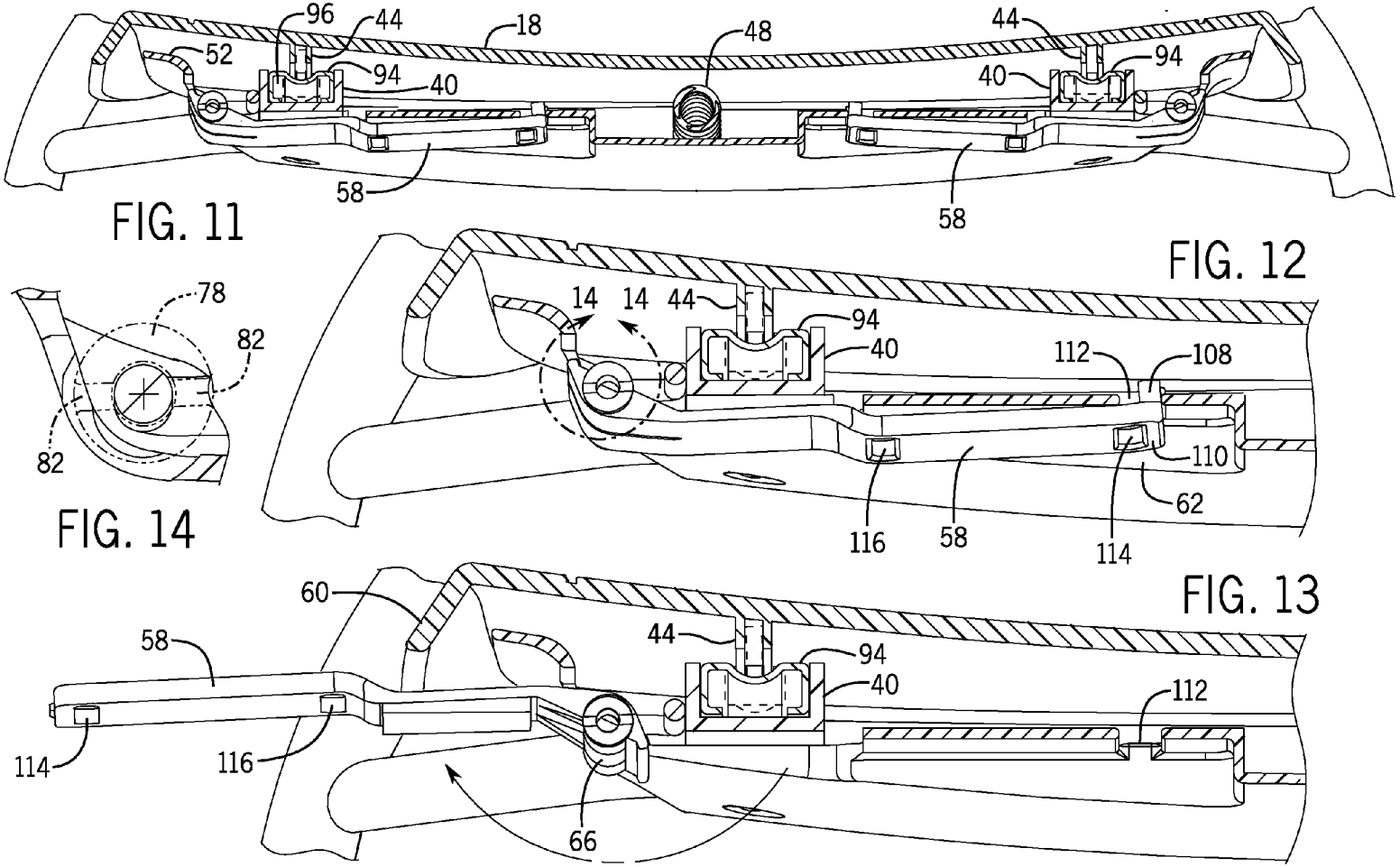
FIG. 11 is a section view taken along line 11-11 of FIG. 3.
FIG. 12 is a partial section view illustrating the support of the seat along the support frame.
FIG. 13 is a view similar to FIG. 12 illustrating the pivoting movement of the ganging arm.
FIG. 14 is a magnified view taken along line 14-14 of FIG.

Referring back to FIG. 6, the support frame 12 includes a front cross bar 36 that extends between the pair of front legs 24*a*. A similar rear cross bar 38 extends between the pair of rear legs 24*b*. The support flame 12 includes a pair of spaced support brackets 40 that extends between the front and rear cross bars 36, 38. Each of the support brackets 40 is a generally U-shaped channel, as best illustrated in FIG. 12.

As illustrated in FIG. 6, the bottom surface 42 of the seat 18 includes a pair of spaced glide rails 44 as well as an attachment bracket 46. As shown in FIG. 7, the attachment bracket 46 receives one end of a bias spring 48. The second end of the bias spring is attached to a tab 50 formed on the rear cross bar 38. The bias spring 48 is held in compression and urges the chair back 16 and the associated seat 18 into an upright position. When the user leans back on the chair back 16, the chair back 16 pivots about the pair of pivot brackets 28, causing the seat 18 to move forward against the force created by the bias spring 48.

As best illustrated in FIGS. 3 and 6, the chair 10 includes a bottom cover 52 that is securely attached to the support frame 12. Specifically, a series of connectors 54 are used to securely mount the bottom cover 52 to the pair of spaced support brackets 40 that form part of the support frame 12. Protective covers 56 conceal the connectors 54 alter attachment of the bottom cover 52 to the support frame 12.

Figure 2:
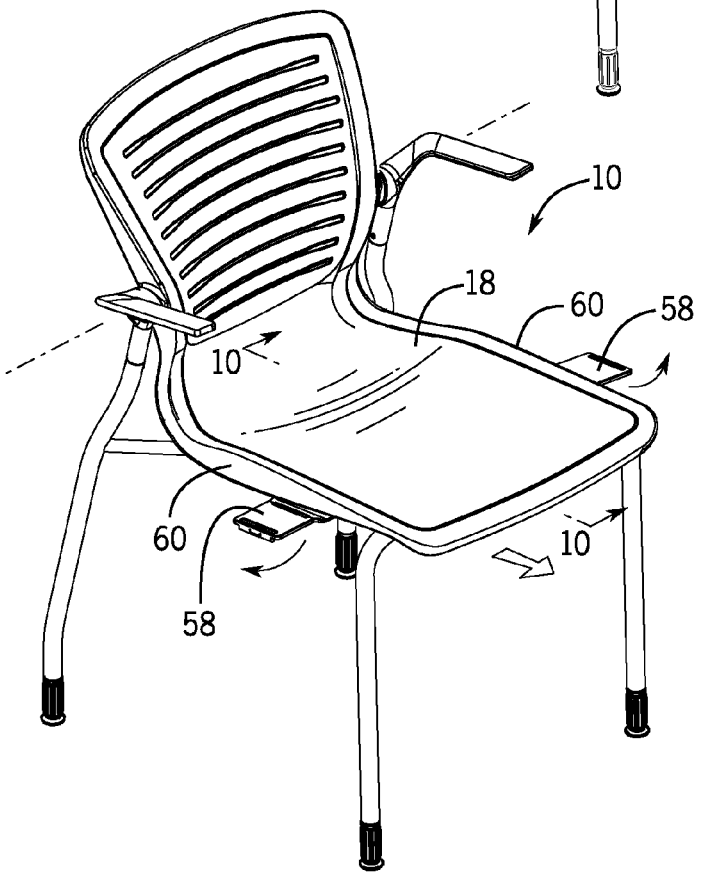
FIG. 2 is a front perspective view similar to FIG. 1 showing a pair of ganging arms in the operative position.

The bottom cover 52 receives a pair of ganging arms 58 that are each movable between a storage position (FIG. 3) and an operative position (FIG. 2). The ganging arms 58 extend laterally past the side edges 60 of the seat 18 when in the operative position. In the operative position shown in FIG. 2, the ganging arms 58 of adjacent chairs 10 can be used to connect adjacent chairs and restrict the separation of the chairs. When the pair of ganging arms 58 are in the storage position, such as shown in FIG. 1, each of the chairs can be used in a normal manner without worry of damaging the ganging arms 58.

Referring back to FIG. 6, the bottom cover 52 includes a pair of receiving cavities 62 that are recessed from the outer surface 64. As can be seen in FIG. 3, when each of the ganging arms 58 are in the storage position, the ganging arms 58 are received within the receiving cavities 62 and are generally flush with the outer surface 64.

Figure 5:
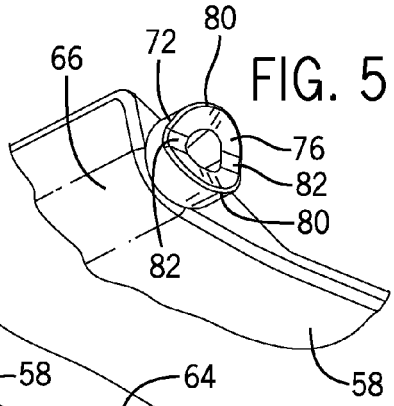
FIG. 5 is a magnified view illustrating a ramming end formed on the ganging arm and taken along line 5-5 of FIG. 4.
Figure 4:
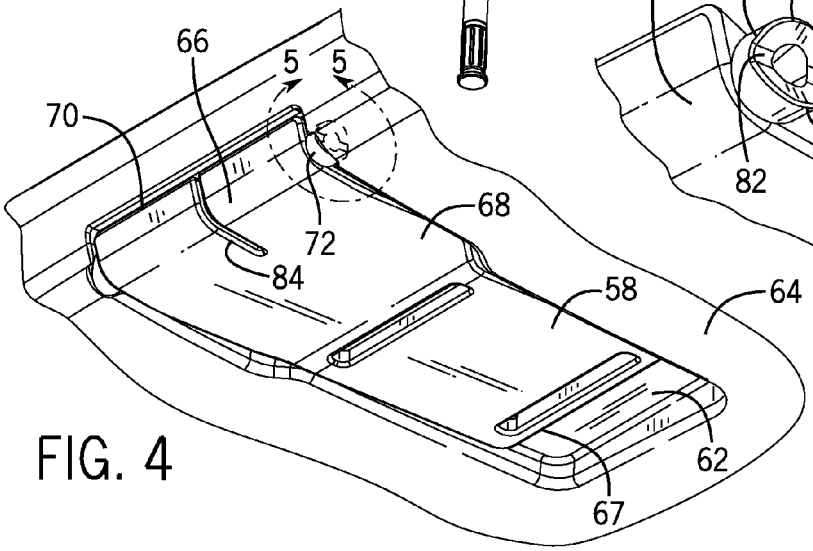
FIG. 4 is a magnified view of one of the ganging aims taken along line 4-4 of FIG. 3.

Referring now to FIG. 4, each of the ganging arms 58 includes an attachment end 66 and an outer end 67. The attachment end 66 includes a generally curved surface that transitions from the outer surface 68 to the outer end 70. The curved attachment end 66 includes a pair of mounting barrels 72, as shown in FIG. 8. The mounting barrels 72 each extend between an inner end 74 and an outer end 76. The outer end 76 defines a cam surface 78. The cam surface 78 can best be seen in FIG. 5. The cam surface 78 includes a pair of axial extending edges SO each separated by a low area 82. The low areas 82 are located 180 ° apart from each other to define two desired positions for the ganging arm 58. The low areas 82 define both the storage position and the operative position for the ganging arms 58 when the ganging arms move from the positions shown in FIGS. 2 and 3.

Referring back to FIG. 4, the ganging arm 58 includes a flexing zone 84 formed in the ganging arm between the pair of mounting barrels 72. The flexing zone 84 is shown in FIG. 4 as being a removed portion of the plastic material that forms the remaining portions of the ganging arm 58. As can be understood in FIGS. 4 and 5, when the ganging arm 58 is rotated, the cam surfaces 78 squeeze the pair of side edges together. The flexing zone 84 allows the ganging arm 84 to flex and thus move between the storage and operative positions.

Referring back to FIG. 8, the inner surface of each ganging aim 58 includes a series of support bridges 86 that strengthen the attachment end 66.

As illustrated in FIG. 7, a mounting bracket 88 is attached to each of the support brackets 40. The mounting brackets 88 shown in FIG. 7 are each created by a bent metal rod having an attachment portion 90 and a pair of spaced ends 92. The spaced ends 92 are each received within one of the mounting barrels 72, as illustrated in FIG. 8. The cam surface 78 formed on each mounting barrel 72 engages the mounting bracket 85 to hold the ganging arm in either the storage position or the operative position.

Figure 15:
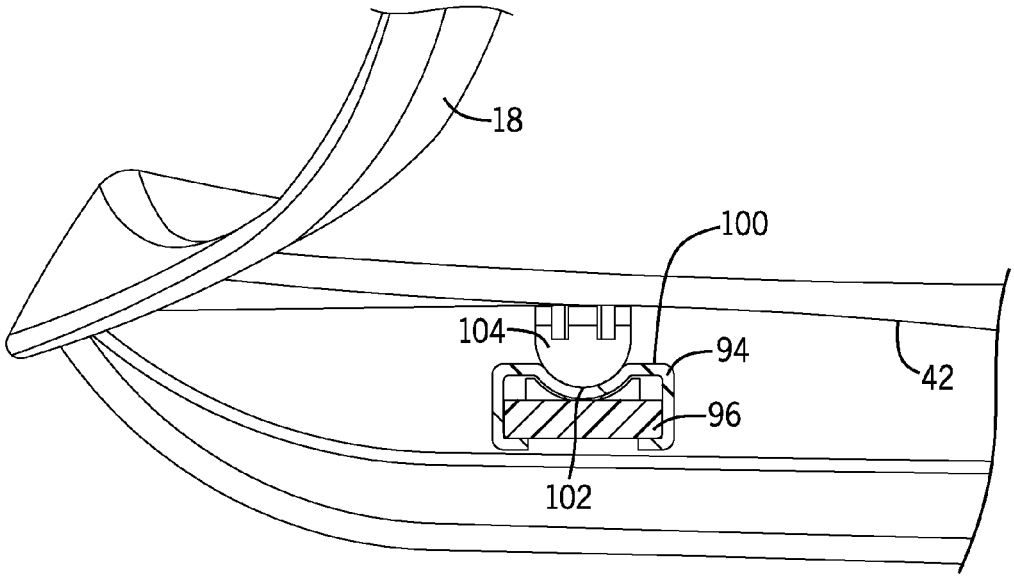
FIG. 15 is a partial section view illustrating the support of the seat along the support frame.
Figure 16:
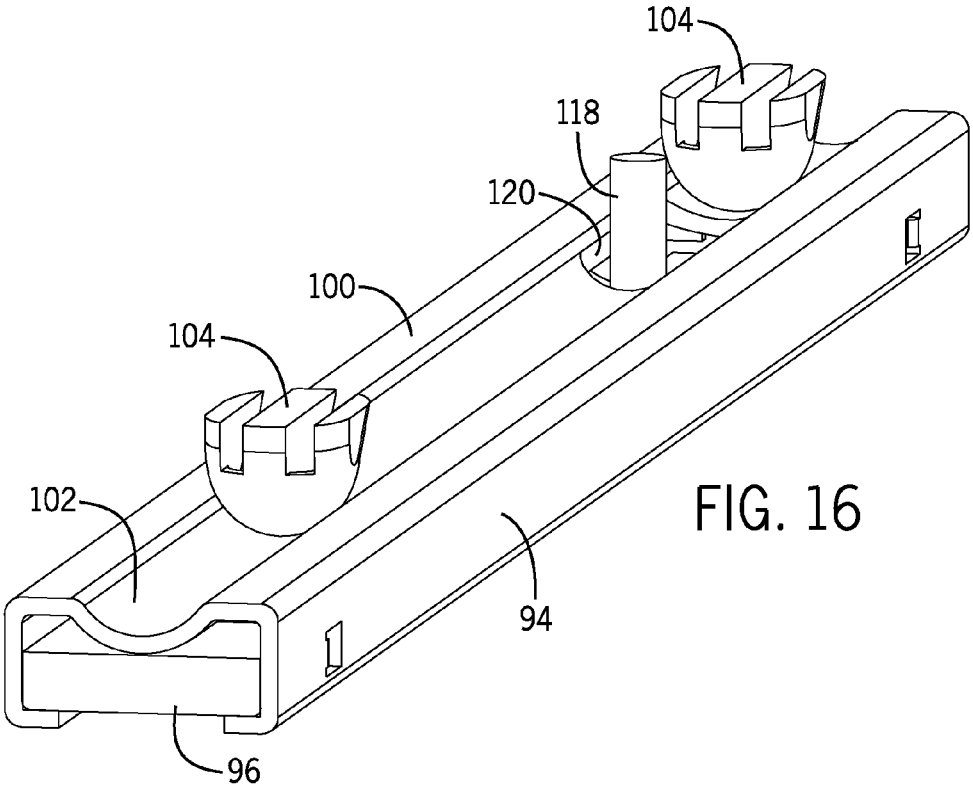
FIG. 16 is a front perspective view illustrating the engagement between a pair of slides and the glide track.

As illustrated in FIGS. 6 and 11, each of the support brackets 40 receives a glide track 94. The glide track 94 is formed from a metallic material and is secured within the support bracket 40 by a pair of retaining nuts 96 that are each attached to a fastener 98. The glide track 94 includes an upper sliding surface 100 that includes a recessed groove 102 having a smooth, curved surface. The recessed groove 102 has a shape that is sized to receive one of a pair of glides 104, as shown in FIG. 15. Each of the individual glides is mounted on the glide rails 44 formed on the bottom surface 42 of the seat 18, as best illustrated in FIG. 6. Referring now to FIG. 16, each of the glides 104 are formed from a durable material having a low coefficient sliding friction, such as UHMW. The glides 104 allow the seat 18 to slide along the length of the glide tracks 94 during the reclining movement by the seat occupant.

Figure 9:
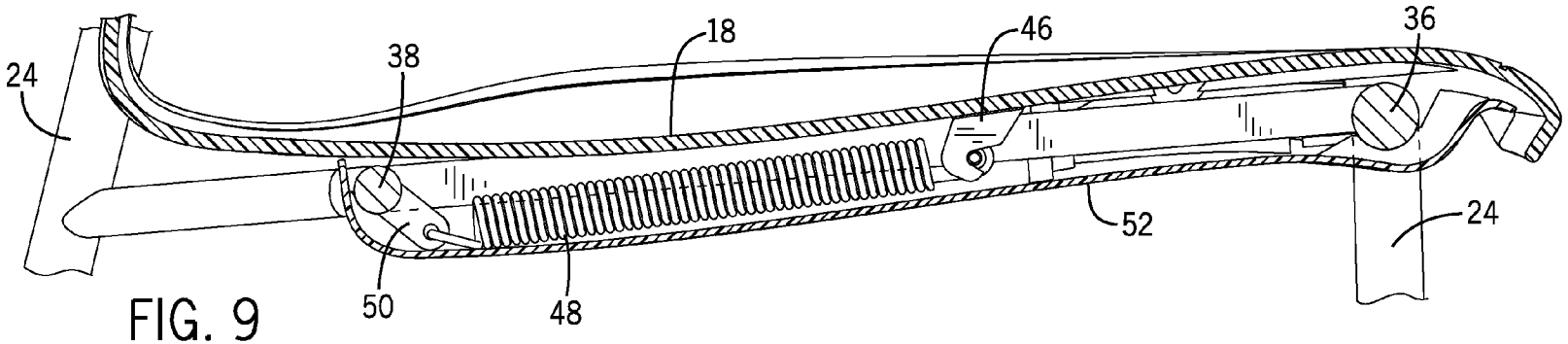
FIG. 9 is a section view taken along line 9-9 of FIG.
Figure 10:
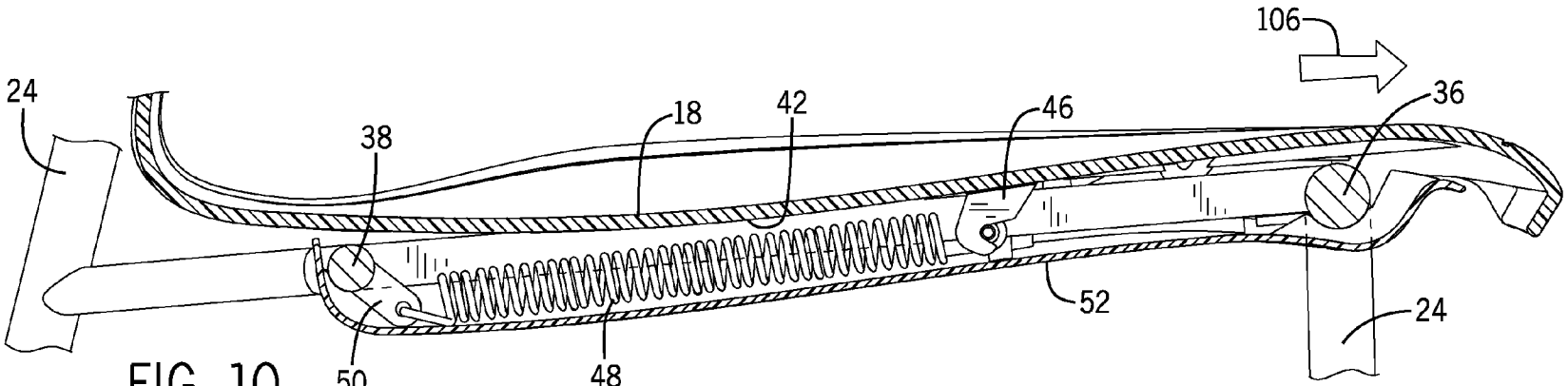
FIG. 10 is a section view taken along line 10-10 of FIG. 2.

In one embodiment of the disclosure, the upper sliding surface 100 of the glide track 94 includes a layer of chrome. The layer of chrome interacts with the glides 104 to provide the desired amount of friction to provide a positive feedback to the seat occupant upon the reclining movement of the chair back 16 and thus the forward movement of the seat. As can be understood in FIGS. 9 and 10, the glide track 94 is slightly inclined such that the weight of the seat occupant provides resistance to movement toward the reclined position. When the seat occupant leans back, the seat 18 moves forward, as illustrated by arrow 106 in FIG. 10, and the bias spring 48 extends. As discussed previously, the first end of the bias spring 48 is connected to the mounting tab 50 while the second end is attached to the attachment bracket 46 mounted to the bottom surface 42 of the seat 18. When the user no longer wishes to recline, the bias spring 48 urges the seat 18 to return to the upright position shown in FIG. 9. As can be understood in FIGS. 9 and 10, the seat 18 moves relative to the stationary bottom cover 52.

FIG. 12 illustrates the position of one of the ganging arms 58 in its storage position. In this condition, an attachment tab 108 formed on the outer end 110 is received within an opening 112 formed within the receiving cavity 62. The attachment tab 108 is sized also to be received within either a first attachment slot 114 or a second attachment slot 116 of a corresponding ganging arm formed on another chair. As can be understood in FIG. 13, when the ganging arms 58 extend laterally outward past the side edge 60, both of the attachment slots 114 and 116 can be utilized. In an embodiment in which the chair includes side anus, the outermost attachment slot 114 is utilized. However, if the arms are removed, the innermost attachment slot 116 could be used for the ganging feature.

FIG. 14 illustrates the cam surface 78 formed as part of the ganging arms 58. The cam surface 78 provides the pair of low areas 82 that define the two positions for the attachment bracket.

Referring again to FIG. 16, a stop screw 118 extends through an open channel 120 formed in the glide track 94. The stop screw 118 contacts the rear glide 104 to define the fully reclined position for the chair. When the chair back is fully reclined, the glide 104 moves toward the stop screw 118 until the glide contacts the stop screw 118.

The present disclosure presents an ergonomic chair that includes a chair back and seat that move together upon reclining movement by the user. The chair includes ganging arms that can be either in an operative, position or a storage position. The ganging arms allow the chairs to be joined to each other when desired. When ganging is not desired, the brackets can be folded underneath the chair to prevent damage to the ganging arms. The seat is movable in a forward direction through the sliding movement of two pair of glides along a glide track. The glide track and glides are formed from specific material to create the desired amount of friction during the movement of the seat.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A chair comprising:

a support frame having a plurality of legs;

a seat supported by the support frame, the seat having a pair of side edges and a seating surface;

a bottom cover mounted to the support frame and having a pair of receiving cavities;

a pair of ganging arms mounted to move relative to the seat between a storage position and an operative position, wherein the ganging arms extend past the side edges of the seat in the operative position and are received in one of the receiving cavities beneath the seat in the storage position;

a pair of mounting brackets each attached to the support frame, wherein each of the mounting brackets supports one of the ganging arms and allows the ganging arms to pivotally move between the storage position and the operative position, and a pair of camming ends formed on each of the ganging arms, each of the camming ends including a cam surface that engages one of the mounting brackets, wherein the cam surfaces urge the ganging arms into either the operative or the storage position.

2. The chair of claim 1 wherein the camming ends are integrally formed with the ganging arms.

3. The chair of claim 1 wherein each of the ganging arms is at least partially recessed from a bottom surface of the bottom cover in the storage position.

4. The chair of claim 1 wherein each of the ganging arms includes a flexing zone positioned between the pair of spaced camming ends.

5. A chair comprising:

a support frame having a plurality of legs, a front cross bar, a rear cross bar and a pair of parallel support brackets extending between the front and rear cross bars;

a chair back pivotally connected between a pair of the legs;

a seat supported by the support frame and movable along the support frame in a direction parallel to the support brackets;

a pair of glide tracks mounted to and parallel to the support brackets, wherein each of the glide tracks includes an upper sliding surface giving a recessed groove; and at least two glides mounted to a bottom surface of the seat, wherein each of the glides is received along the recessed groove of the upper sliding surface of one of the glide tracks to guide the movement of the seat.

6. The chair of claim 5 wherein at least the upper sliding surface of the glide tracks is plated with chrome.

7. The chair of claim 5 further comprising a stationary bottom cover mounted to the support frame beneath the seat.

8. The chair of claim 5 further comprising a pair of ganging arms mounted to move relative to the seat between a storage position and an operative position, wherein the ganging arms extend laterally past spaced side edges of the seat in the operative position and are positioned beneath the seat in the storage position.

9. The chair of claim 8 wherein each of the ganging arms includes a pair of camming ends that urge the ganging anus into either the operative position or the storage position.

10. The chair of claim 5 wherein the seat and the chair back are integrally formed and are movable between an upright position and a reclined position.

11. The chair of claim 10 further comprising a bias member connected between the support frame and the seat to urge both the seat and the chair back into the upright position.

12. A chair comprising:

a support frame having a plurality of legs, a front cross bar, a rear cross bar and a pair of parallel support brackets extending between the front and rear cross bars;

a chair back pivotally connected between a pair of the legs;

a seat supported by the support frame and movable aloe the support frame in a direction parallel to the support brackets;

a pair of glide tracks mounted to and parallel to the support brackets, wherein each of the glide tracks includes and upper sliding surface;

at least two glides mounted to a bottom surface of the seat, wherein each of the glides is received along the upper sliding surface of one of the glide tracks to guide the movement of the seat; and a pair of removable arms mounted to the support frame at the pivotal connection between the support frame and the Chair back.

13. A chair comprising:

a support frame having a plurality of legs, a front cross bar, a rear cross bar and a pair of parallel support brackets extending between the front and rear cross bars;

a chair shell mounted to the support frame, the chair shell including an integrally formed chair back and seat, wherein the chair back is pivotally connected between a pair of the legs and the seat is movable relative to the support frame in a direction parallel to the support brackets;

a pair of glide tracks mounted to and parallel to the support brackets, wherein each of the glide tracks includes an upper sliding surface having a recessed groove; and at least two pair of glides mounted to a bottom surface of the seat, wherein the two pairs of glides are received along the recessed groove of the upper sliding surface of the glide tracks to guide the movement of the seat.

14. The chair of claim 13 wherein the chair shell is movable between an upright position and a reclined position.

15. The chair of claim 13 further comprising a bias member connected between the support frame and the seat to urge both the seat and the chair back into the upright position.

16. The chair of claim 13 wherein each of the glide tracks includes an upper sliding surface that receives the glides, wherein the upper sliding surface includes a recessed channel and is plated with chrome.

* * * * *

UNITED STATES PATENT AND TRADEMARK OFFICE

CERTIFICATE OF CORRECTION

PATENT NO. : 9,144,311 B2
APPLICATION NO. : 13/911442
DATED : September 29, 2015
INVENTOR(S) : Francisco Romero It is certified that error appears in the above-identified patent and that said Letters Patent is hereby corrected as shown below:

On the Title Page:

In the Abstract (57):

In line 4, delete the "," after "spring".

In the Claims:

In column 6, claim 5, line 47, delete "giving" and insert --having--.
In column 6, claim 9, line 63, delete "anus" and insert --arms--.
In column 7, claim 12, line 9, delete "aloe" and insert --along--.

Signed and Sealed this
Fifteenth Day of March, 2016

Michelle K. Lee

Michelle K. Lee
*Director of the United States Patent and Trademark Office*